US005123483A

United States Patent [19]

Tokutake et al.

[11] Patent Number: 5,123,483

[45] Date of Patent: Jun. 23, 1992

[54] HEAT EXCHANGER

[75] Inventors: Toshinori Tokutake; Mitsuru Nobusue; Tatsuya Hanafusa, all of Oyamashi, Japan

[73] Assignee: Showa Aluminum Kabushiki Kaisha, Osaka, Japan

[21] Appl. No.: 771,755

[22] Filed: Oct. 4, 1991

[30] Foreign Application Priority Data

Oct. 8, 1990 [JP] Japan ..... 2-106089[U]
Jan. 22, 1991 [JP] Japan ..... 3-5939

[51] Int. Cl.[5] ..... F28F 9/22; 165 174; 165 176; 29 890.052

[52] U.S. Cl. ..... 165/176; 165/174

[58] Field of Search ..... 165/174, 176; 29/890.052

[56] References Cited

U.S. PATENT DOCUMENTS

| | | | |
|---|---|---|---|
| 1,078,271 | 11/1913 | Force et al. | 138/94.3 |
| 3,806,038 | 1/1975 | Forni | 138/94.3 |
| 4,825,941 | 5/1989 | Hoshino et al. | 165/110 |
| 4,936,381 | 6/1990 | Alley | 165/176 |
| 5,048,578 | 8/1991 | Tanabe | 165/174 |

FOREIGN PATENT DOCUMENTS

| | | | |
|---|---|---|---|
| 57-38169 | 3/1982 | Japan . | |
| 59-229195 | 12/1984 | Japan | 165/176 |
| 60-91977 | 6/1985 | Japan . | |
| 56-149295 | 11/1987 | Japan . | |
| 63-173689 | 11/1988 | Japan . | |
| 2-92494 | 7/1990 | Japan . | |
| 3-32944 | 7/1991 | Japan . | |

*Primary Examiner*—Allen J. Flanigan

[57] ABSTRACT

The ends of numerous tubes are connected to hollow headers so that they are in fluid communication with the headers. Slit shaped apertures are formed in the outside face of the headers in the direction of their circumference, and partititions are inserted through the apertures. Each partition is constructed out of two partition plates which fit into the header through the aperture in superimposed position. Alternatively, the partition plates may be connected integrally at one end so that their unconnected ends tightly contact the edges of the slit shaped aperture. The partitions are then braced to the header to become integral with it.

13 Claims, 10 Drawing Sheets

HEAT EXCHANGER

BACKGROUND OF THE INVENTION

1. Field of the Invention

The invention relates to a heat exchanger, particularly to a heat exchanger which is best suited for use as a condenser or the like in air conditioners for the home or for vehicles.

2. Description of Prior Art

For example, previously the so-called serpentine type of heat exchangers have been used as heat exchangers for the purpose noted above. Forming the core of this serpentine type heat exchanger is a flat, perforated extruded tube a called harmonica tube which is bent into a serpentine shape with fin members interposed between the parallel portions formed between the bends of the tube. However, there have been a number of factors regarding these serpentine type of heat exchangers which limited the possibilities for efficiency improvement. One of which is that since the passage for the heat exchanging medium is formed by a single flat extruded tube, the area of passage cannot be ensured to be large. Also, because the extruded tube is bent into a serpentine shape, it is impossible to make the radius of curvature of the bends smaller than a certain limit, so the pitch of the tubes cannot be made small which limits the number of fin members that can be placed between the parallel portions of the tube and thus the efficiency of the fin members is poor.

Because of this, in recent years the so-called multi-flow type of heat exchangers have been appearing as replacements for the serpentine type of heat exchangers. Numerous flat, protruded tubes and fin members are alternately placed next to each other in this type of heat exchanger with both ends of the tubes connected to hollow headers. With this type of heat exchanger, since it is possible to freely select the tube pitch, it is possible to ensure that the cross-sectional area of the passage for the heat exchanging medium is large. Also, the number of fin members between the tubes can be increased making it possible for a small sized heat exchanger to perform with outstanding efficiency.

There are some cases in which these multi-flow types of heat exchanger, in order to let the heat exchanging medium flow through in a serpentine shaped pattern as occurs in the serpentine type of heat exchanger, partition members have been employed to split one or both of the headers' interiors into a plurality of partitioned chambers. By doing this, a serpentine shaped passage is formed by the tubes for the passage of the heat exchanging medium ( see Japanese Utility Model Publication Hei. 3-32944 and Utility Model Early Publication Hei. 2-92494).

FIG. 19 is an illustration of representative construction of these types of partition members. A slit shaped aperture 52 half the circumference of the header is formed along one edge of the header 51. The partition is constructed out of a roughly circular shaped partition plate 53 with a smaller diameter inner semicircular part 54 which conforms to the shape of the interior of the header 51 and a large diameter outer semicircular part 55 which conforms to the exterior surface of the header 51. Also, the inner semicircular part 54 of this partition plate 53 fits through the aperture 52 from the outside and is fitted into the inside of the header 51. Consequently, the inner semicircular part 54 contacts with the interior face of the header 51, while the outer semicircular part 55 is positioned so that exterior perimeter of the header 51 forms a single, continuous surface and is brazed or soldered to the header 51 and integrated therewith. Also indicated in the drawings are the tubes 56 and the corrugated fin members 57.

However, with regard to the relationship between the thickness of the partition plate 53 and the height of the slit shaped aperture 52, generally the partition plate 53 is designed such that its thickness is somewhat smaller than the height of the slit shaped aperture 52 so that errors of dimension or shape of these parts occurring during the manufacture or processing thereof will not make it difficult to insert the partition plate 53 into the slit shaped aperture 52. Consequently, in the above noted partition structure, between the time the partition plate 53 is fitted into the header 51 and brazed thereto, sometimes the partition plate 53 falls or slips out of place and is not brazed into its proper position.

Other examples proposed as structures to use partitions 61 to replace the partition plate discussed above are shown in FIGS. 20A and 20B. With this partition 61 a banded part 63 that conforms to the exterior surface of the header 51 is integrated into the outer semicircular part **62*b* of the partition plate 62 which corresponds to the aforementioned partition plate 53 so that arc-shaped lip-like ribs 63*a* jut out from the upper and lower ends of the partition plate 62. Also, this partition 61 allows the partition plate 62 to fit inside the header 51 through the slit shaped aperture 52, so that the inner semicircular part 62*a* contacts with the interior surface of the header 51 and both the lower and upper ribs 63*a* cover both sides of the aperture 52 exterior noted above and are brazed to the header 51** in that position to become integral therewith.

With regard to the partition 61 of this proposal, due to the brazing or soldering fillet between the exterior surface of the header 51 and the interior surface of the ribs **63*a*, the strength of the joint is improved. However, because the upper and lower ribs 63*a* are formed by a forging process, the productivity is poor and there are difficulties in creating ribs of sufficient height. Furthermore, another drawback is that, due to positioning defects in the partition, the efficiency of the heat exchanger is likely to deteriorate with this type of partition. Namely, when forming the slit shaped aperture 52 in the header 51 by notching or the like processing, sometimes deformations occur such as a turning up or bending of the edge of the slit shaped aperture 52. Because of the ribs 63*a* on the partition proposed above, it is very susceptible to the effect of these deformations. For example, even if one of the edges 52*a* of the aperture 52 is only slightly turned up as shown in FIG. 21, this causes the partition 61 to slant and a gap 64 to occur between the inner semicircular part 62*a* of the partition plate 62 and the interior of the header 51**.

OBJECTS AND SUMMARY OF THE INVENTION

The present invention was made in consideration of the problematic points stated above. An object of this invention is to make it possible for the partition to be easily inserted into the slit shaped aperture formed in the header and also to have it fitted securely into its proper place in order to provide a heat exchanger with highly reliable partition structure.

One of the other objects of this invention is to enable simple insertion and placement of the partition in the slit shaped aperture formed on the header so that the partition will be properly inserted and positioned and will not fall out of the header or slip out of place before the brazing is completed, in order to provide a heat exchanger with a highly reliable partition structure.

Further objects and advantages of this invention will become clear in the embodiments which will be described hereinafter. It must be recognized that the following embodiments are meant clearly demonstrate the preferred modes of the invention. Accordingly, this invention is not limited to these embodiments but permits countless other design choices provided they are within the range of and in the spirit of this invention.

In one of the preferred modes, a heat exchanger comprises:

a plurality of tubes;

hollow headers connected to ends of the tubes in fluid communication therewith;

partitions inserted and arranged through slit shaped apertures formed on the headers in the direction of their circumference; and each of the partitions being constructed out of two partition plates that are passed through the slit shaped apertures in a superimposed position so as to fit in the headers, and brazed or soldered integral therewith.

In this way, due to the use of partitions that are each constructed out of two partition plates, at least one of the partition plates will be inserted into the header in the proper position to achieve a more reliable partitioning. Furthermore, for example, following the insertion of one of the partition plates through the slit shaped aperture and the positioning of it in the header, because the other partition plate is inserted in a superimposed condition on the previously inserted plate, both partition plates will be fitted and positioned properly inside the header. Even if the first partition plate was temporarily unsatisfactorily inserted into the header, when the other partition plate is inserted, due to frictional resistance between them, the partition plate first inserted will be pulled towards the back wall of the header so that the inside edge of the plate will be properly positioned to infallibly contact with the interior surface of the header. In addition, with both partition plates inserted, their outer edges fit in the slit shaped aperture so that both partition plates become superimposed and a reliable partitioning is achieved.

In another preferred mode of the present invention, a heat exchanger comprises:

a plurality of tubes;

hollow headers connected to ends of the tubes in fluid communication therewith; and each of the partitions being composed of a pair of partition plates which are jointed to each other integrally at their ends, are positioned inside the slit shaped aperture in a superimposed position with their unjointed ends in contact with the inside edge of the slit shaped aperture, and are brazed in that position to the header to become integral therewith.

This partition is constructed such that the pair of partition plates which have been connected together are arranged inside the header so that their unconnected ends contact the edge of the slit shaped aperture before it is brazed, thus always ensuring the reliable brazing of the partition to the header in the correct position

THE PREFERRED EMBODIMENTS

First Embodiment

Figure 1:
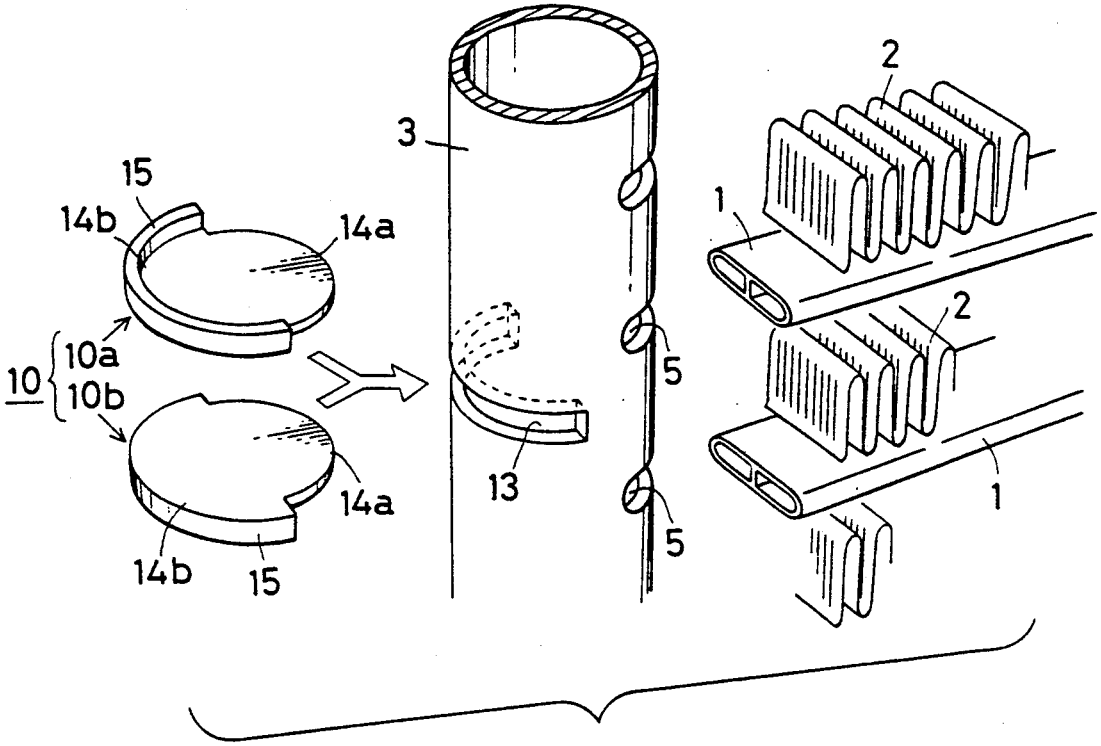
FIG. 1 is a perspective view showing in a disassembled state a header, tubes, fins and partition plates of a heat exchanger provided in a first embodiment of the invention.

The preferred embodiments of the invention will now be described in detail referring to the drawings.

FIGS. 1 to 6 show a heat exchanger used as a condenser for a car air conditioner. The reference numeral 1 denotes a plurality of horizontal tubes arranged in an up-down direction, with the reference numeral 2 denoting corrugated fin members disposed between adjoining tubes 1 and 1. The inside perforated tubes 1, called harmonica tubes, which are flat extruded tubes and made of aluminum material, are utilized to improve pressure resistance and heat conducting capacity by separating the interior into chambers with partitioning walls. Seam-welded pipes may be employed in place of the extruded tubes. The corrugated fin members 2 have approximately the same width as the tubes 1 and are jointed to the tubes 1 by brazing. The corrugated fin members 2 are also made of aluminum and it is advisable that louvers be opened up.

Figure 2:
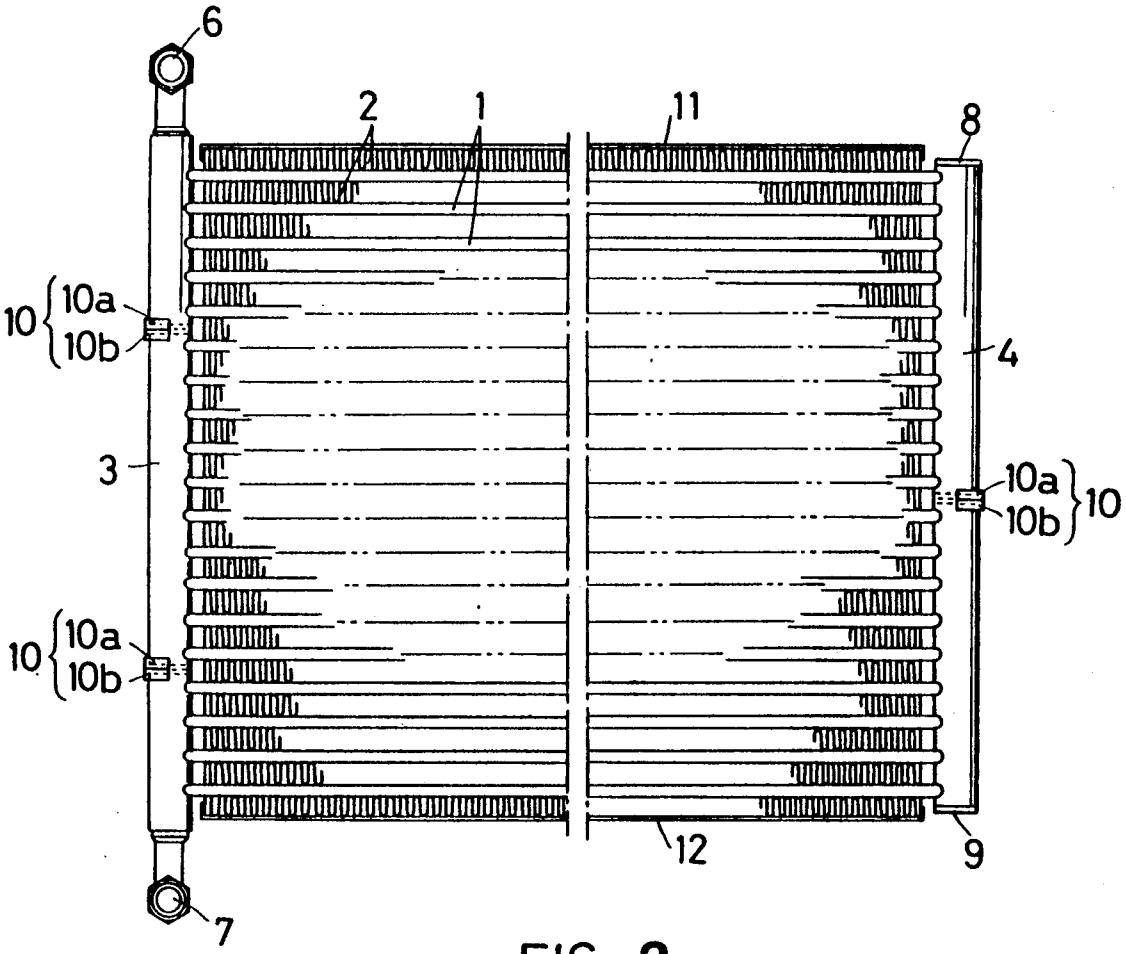
FIG. 2 is a front elevation of the heat exchanger.
Figure 3:
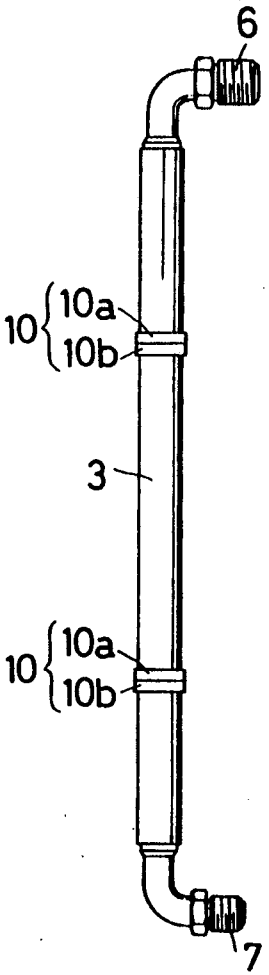
FIG. 3 is a side elevation of the heat exchanger.

The reference numerals 3 and 4 denote left and right headers which are seam-welded aluminum pipes circular in cross section. Tube insert holes 5 are cut out of and spaced along each header 3 and 4 in a longitudinal direction. Both ends of each tube 1 are inserted into these holes 5 and firmly attached thereto by brazing. Further, to the upper end of the left header 3 a coolant inlet pipe 6 is connected, while to the lower end of the left header a coolant outlet pipe 7 is connected. Also, caps 8 and 9 are attached to the top and bottom ends of the right header 4. Partitions 10 are disposed in the left header 3 at positions between the center and top end, and between the center and bottom end of the header 3, partitioning it into three chambers. A further partition 10 is also disposed approximately at the center of the right header 4, partitioning it into two chambers. Due to the establishment of these partitions 10, coolant flows in through the coolant inlet pipe 6 into the left header 3, then advances through all the passages made up of the groupings of tubes, in a serpentine shaped pattern, until finally flowing out of the coolant outlet pipe 7. In addition, side plates 11 and 12 are arranged on the upper and lower outside edges of the outermost corrugated fin members 2, as shown in FIG. 2.

Figure 4A:
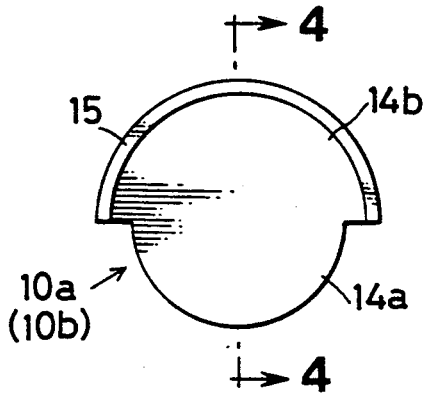
FIG. 4A is a plan view of the partition plate.
Figure 4B:
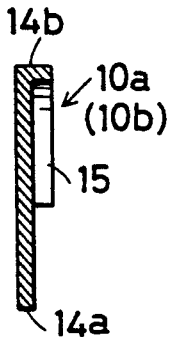
FIG. 4B is a cross section taken along the line 4—4 in FIG. 4A.

Slit shaped apertures 13 are formed along the outside surface of the headers 3 and 4 at the places where the partitions are to be attached. These slit shaped apertures 13 extend across half the circumference of the headers 3 and 4. As shown in FIG. 1, each partition 10 is composed of two partition plates **10*a* and 10*b* of uniform shape. As is shown in FIGS. 4A and 4B, these partition plates 10*a* and 10*b* are generally circular in shape with their small diameter inner semicircular parts 14*a* conforming to the shape of the inside surface of the headers 3 and 4, while their large diameter outer semicircular parts 14*b* conform to the external surfaces of the headers 3 and 4. Arc-shaped ribs 15 jut out on one side along the outside edge of the large diameter semicircular part 14*b*, and these ribs 15 are shaped such that their inside surfaces conform to the exterior of the headers 3 and 4. These partition plates 10*a* and 10*b* are easily manufactured by the pressing technique. Except for the rib portion 15, it is desirable that the flat portion of each partition plates 10*a* and 10*b* decrease its thickness slightly and gradually from the outer semicircular part 14*b* towards the inner semicircular part 14*a* in order to facilitate insertion of the partition through the aperture 13 into the headers 3 and 4**.

Figure 5A:
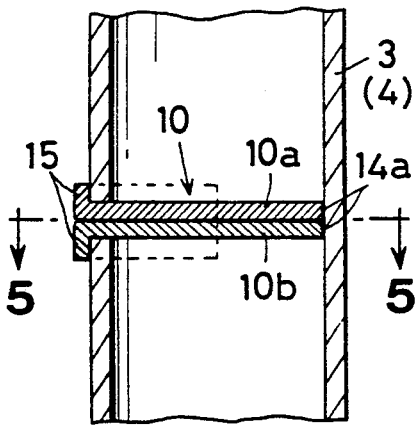
FIG. 5A is a vertical cross section of the header with the partition plates fitted in position.
Figure 5B:
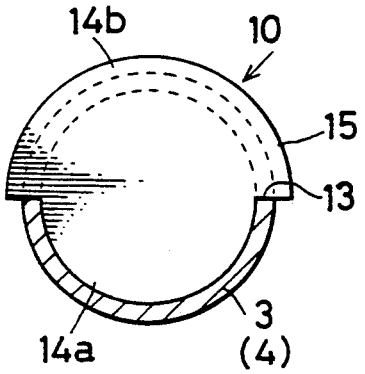
FIG. 5B is a cross section taken along the line 5—5 in FIG. 5A.

As for the construction of the double-plated partition comprising the two plates **10*a* and 10*b*, they are superimposed in a back-to-back relation with their rib portions 15 facing outside and away from each other, as shown in FIGS. 1, 5A and 5B. When the partition plates are inserted through the slit shaped aperture 13 into the headers 3 and 4, the inner semicircular parts 14*a* bear against the inside surface of the headers, and the inside surfaces of the ribs 15 are brought into close contact with the outside surfaces around both edges of each aperture 13. Then the partitions are brazed to the headers 3 and 4 in that state to become integral therewith. The best way to perform this brazing step is to manufacture the headers 3 and 4 as well as the partition plates 10*a* and 10*b*, etc., out of aluminum brazing sheet and to braze them one to another in the so-called one-shot operation. However, any other proper way may be employed. It is preferable that the partition plates 10*a* and 10*b*** are coated with brazing agent along and over their opposing surfaces to be joined.

Figure 6:
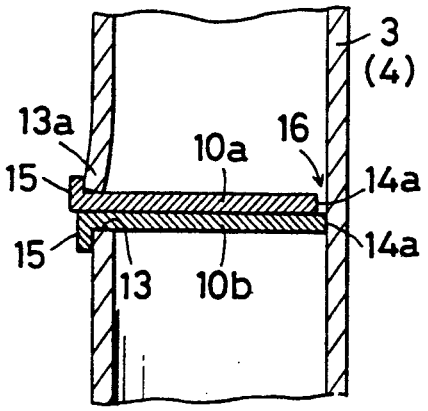
FIG. 6 is a vertical cross section of the header with the partition plates fitted in a slit shaped aperture which is partially deformed.

When the slit shaped apertures 13 in the headers 3 and 4 are formed by notching or a similar technique, sometimes it is impossible to avoid deformation such as the bending or turning up of the edge of the slit. FIG. 6 shows a state in which one edge **13*a* of the aperture 13 has become slightly turned up, adversely affecting the rib 15 of the partition plate 10*a* on the side with the deformed edge 13*a*. This state will bring about a defect in that the partition plate 10*a* becomes imperfectly fitted as a gap 16 forms between the inside surface of the header 3 or 4 and the inner semicircular part 14*a* of the partition plate. However, even if such a condition occurs as shown in FIG. 6, the other partition plate 10*b* according to the invention will be arranged normally and its inner semicircular part 14*a* will come into contact and join with the inner surface of the headers 3 and 4 so that perfect partitioning is ensured after brazing. Unless the deformation at the apertures 13 is extremely severe, a satisfactory sealing will be obtained by brazing due to the engagement of the partition plate 10*a* with the edge 13*a* of the aperture 13**.

Though the inner semicircular part **14*a* of the partition 10 contacts with the inner surface of the header, additional slits may be formed in the wall facing the slit shaped apertures 13** which are normally formed in the embodiment described above. In this case, leading ends of the inner semicircular parts will protrude into the additional slits.

The embodiment discussed above shows partitions with ribs formed on the outer semicircular part of each partition plate. It is also possible to dispense with such ribs. With this latter type as well, at least one of the partition plates will be correctly arranged to achieve the reliable partitioning. Also, following the insertion of one of the partition plates through the slit shaped aperture and the positioning of it in the header, because the other partition plate is inserted in a superimposed condition on the previously inserted plate, both partition plates will be fitted to take their correct positions. Even if the first partition plate was at first unsatisfactorily inserted into the header, when the other partition plate is inserted, the partition first inserted will be pushed to its fully inserted regular position to come into contact with the inside surface of back wall of the header, due to the frictional resistance between them. In addition, when both partition plates have been inserted, their outer edges fit in and engage with the slit shaped aperture so that the two partition plates become superimposed on each other to ensure a reliable partitioning.

Second Embodiment

Next, a heat exchanger best used as a condenser for air conditioners of automobiles and which is provided in a second embodiment of the invention will be described.

Figure 8:
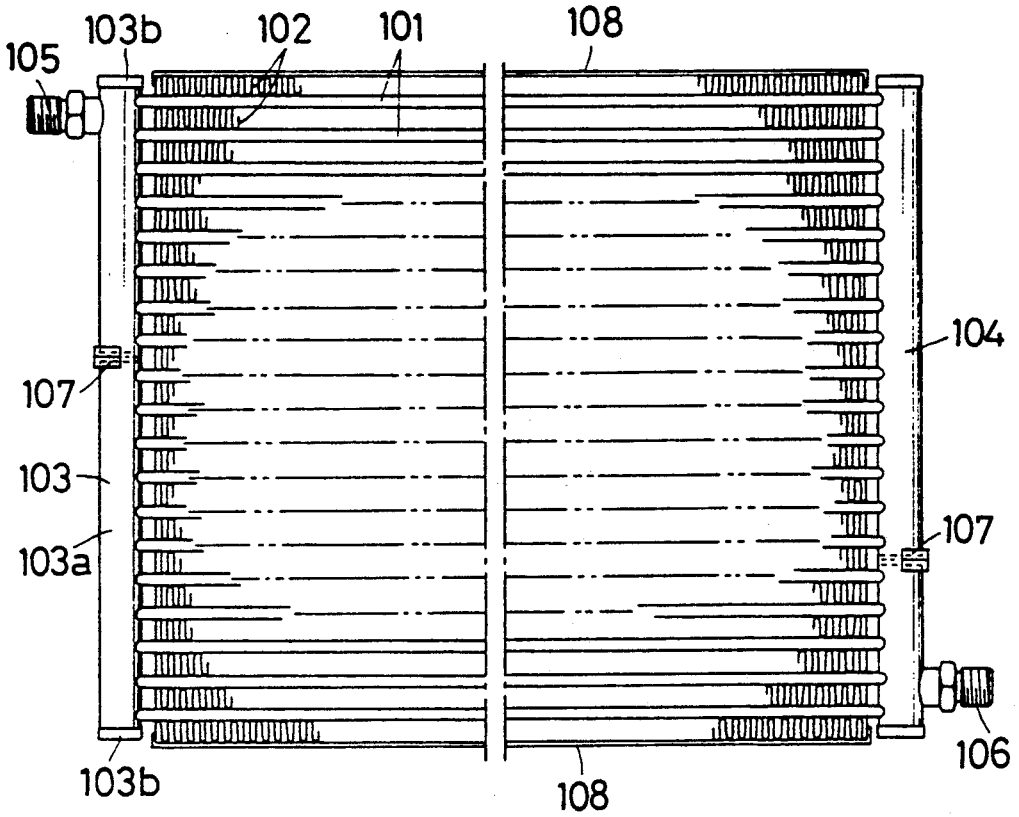
FIG. 8 is a front elevation showing the heat exchanger in its entirety.
Figure 9:
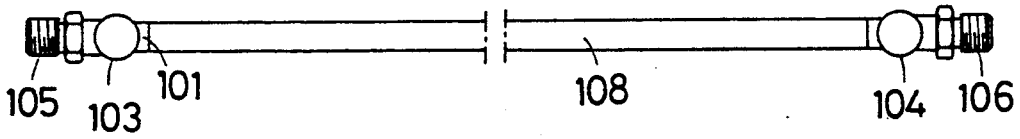
FIG. 9 is a plan view the heat exchanger.

In the heat exchanger shown in FIGS. 8 and 9, a plurality of flat tubes 101 and corrugated fin members 102 are arranged parallel to each other and in the up/-down direction. The reference numerals 103 and 104 denote left and right headers, to which both ends of each tube 101 are connected in fluid communication therewith. The reference numeral 105 denotes a coolant inlet pipe attached to and in fluid communication with the left header 103, while a coolant outlet pipe 106 is attached similarly to the right header 104. The further reference numeral 107 denotes partitions which are disposed at predetermined heights inside the headers 103 and 104. Due to these partitions 107, the heat exchanging medium flows through the passages formed by the plurality of the tubes 101 in a serpentine pattern. The still further numeral 108 denotes side plates which are arranged along the top and bottom edges of the outermost corrugated fin members 102.

The flat tubes 101 used here are the so-called harmonica type tubes which are made by extruding aluminum material.

The corrugated fin members 102 are made by using an aluminum sheet of approximately the same width as the tubes 101 and shaping it into a corrugated form with opened louvers. An aluminum brazing sheet cladded or covered with a layer of brazing agent is advantageously employed here.

Figure 7:
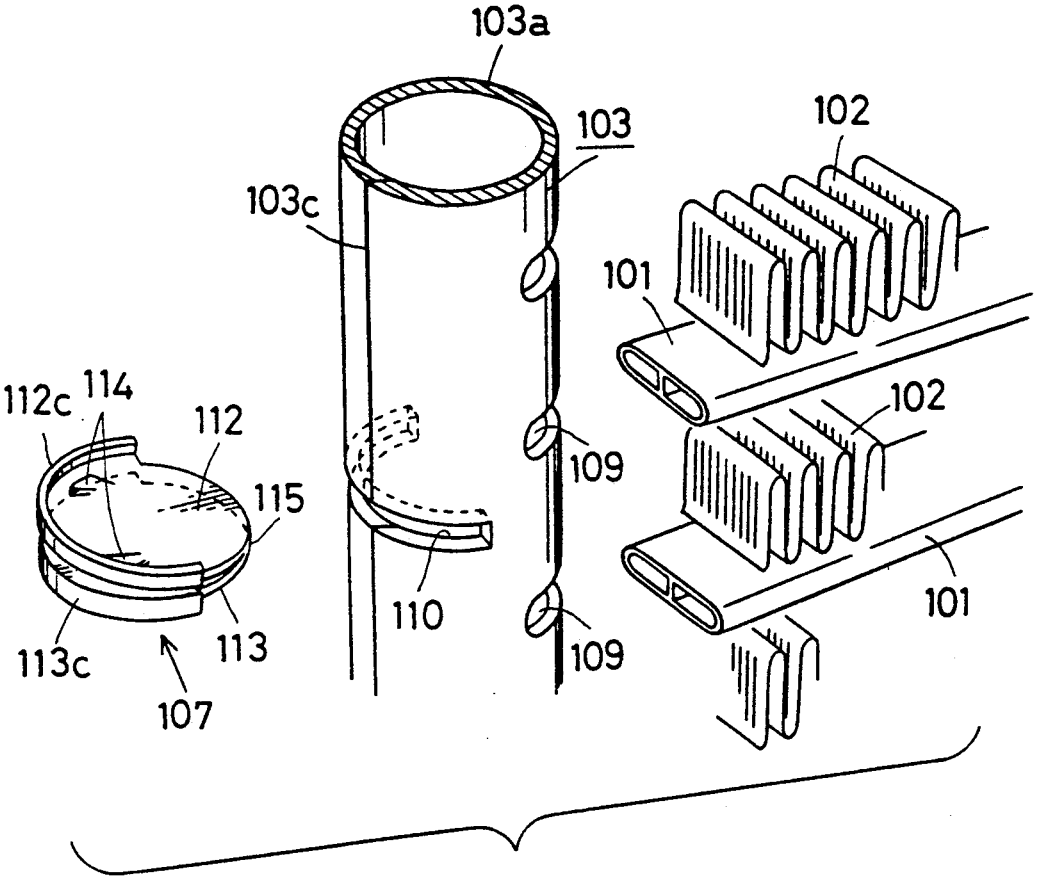
FIG. 7 is a perspective view showing in a disassembled state a header, tubes, fins and partition plates of a heat exchanger provided in a second embodiment of the invention.

An aluminum brazing sheet coated on one or both of its sides with a brazing agent layer is shaped so that both of its edges abut each other to form a cylindrical header pipe 103*a*, from which the header 103 is formed wherein end openings of this pipe are closed with aluminum caps 103*b*. The other header 104 is also made in the same manner as the header 103. However, the headers 103 and 104 may alternatively be made out of extruded or seam-welded pipe instead of the bent brazing sheet type of pipe mentioned above. As shown in FIG. 7, slit-shaped tube insertion holes 109 are cut in the side face of the header 103 in the direction of its circumference. These holes are spaced a predetermined distance from each other so as to form a row longitudinally along the header.

A slit shaped aperture 110 extending approximately halfway along the circumference of the header 103 is formed on its portion opposite to the tube insertion holes 109, at a position between two of said holes. Further, because the tube insertion holes 109 are not formed across the seam 103*c* where the ends of the header pipe 103*a* are abutted together, the slit shaped aperture 110 is formed across this seam 103*c*.

The partition 107 is made up of a pair of symmetrical aluminum partition plates 112 and 113 that are in a superimposed position and connected to each other at one of their ends. The unconnected ends of said plates are somewhat opened so that when viewed from the side they appear roughly V-shaped.

Figure 10:
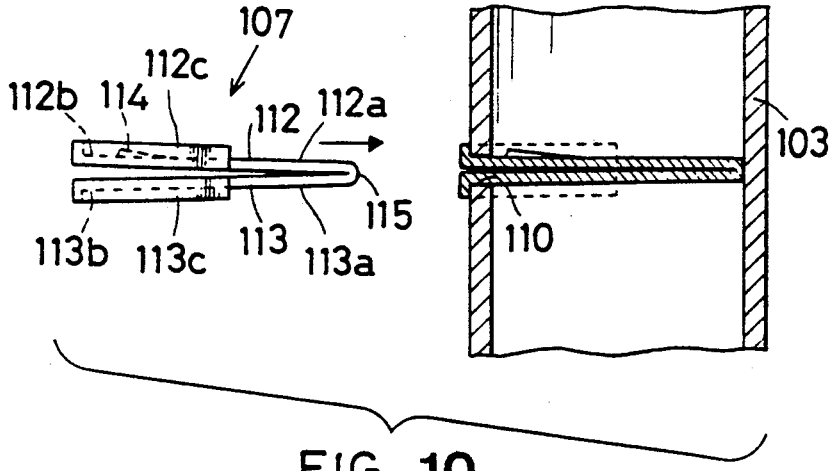
FIG. 10 is a vertical cross section of the header with the partition plates constituting a partition fitted in position.
Figure 11:
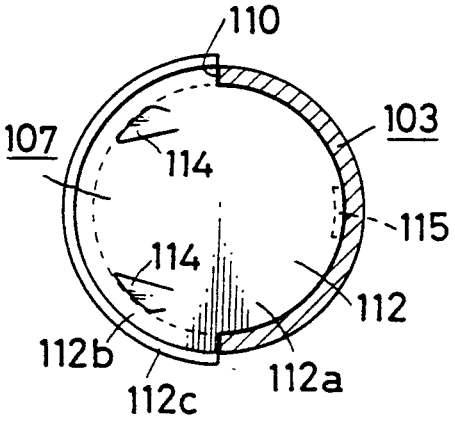
FIG. 11 is a horizontal cross section of the header with the partition fitted in position.

As shown in FIGS. 7, 10 and 11, the partition plates 112 and 113 are made up of circular shaped partitioning parts 112*a* and 113*a* which conform to the shape of the inside perimeter of the header 103, with the unconnected semicircular portions of these partitioning parts 112*a* and 113*a* extending radially towards the outside so that their outer ends 112*b* and 113*b* integrally protrude outwards. Ribs 112*c* and 113*c* are integral with edges of the protruding ends 112*b* and 113*b* and rise up therefrom in opposite directions. Also as shown in FIGS. 10 and 11, small protrusions 114 are formed on one side of the partition plate 112. The protrusions 114 are uplifted, slanted and tapered in the direction of the protruding end 112*b*, from a position within the partitioning part 112*a* to the border between it and the protruding end 112*b*, whereby the partition is stopped from slipping out.

Figure 12:
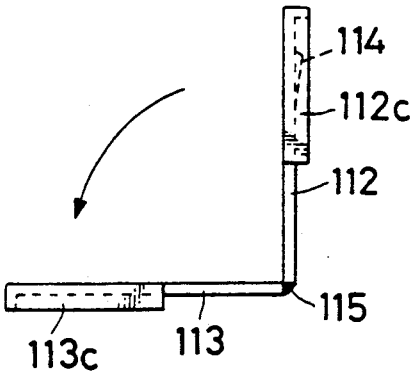
FIG. 12 is a side elevation showing an example of methods for manufacturing the partition.
Figure 13:
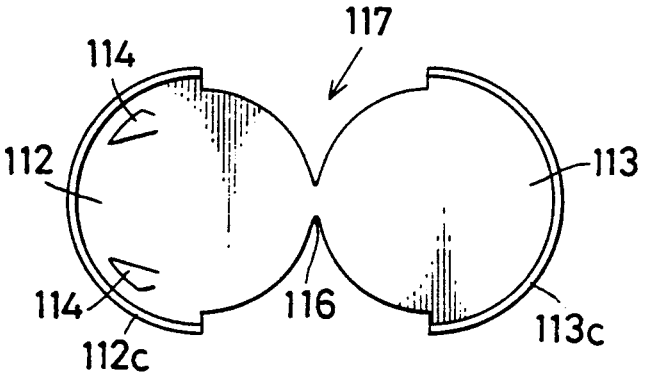
FIG. 13 is a plan view showing another example of the methods for manufacturing the partition.

This partition 107 is made as shown in FIG. 12 by abutting the ends of the two aluminum partition plates 112 and 113, which are manufactured by the pressing technique, to each other with the plates maintained at a predetermined angle, for example at 90°, and connecting the abutted ends by brazing or the like technique. Subsequently, the thus connected partition plates 112 and 113 are bent at a joint 115 so that the sides without the ribs 112*c* and 113*c* are superimposed upon each other.

Another way to manufacture the partition is to prepare at first a preformed article 117 by pressing an aluminum sheet. The partition plates 112 and 113 in this case are united with each other by a very short connecting strip 116 so that they can be folded over each other. With this manufacture method the plates should be designed such that any bulge originating from the short strip 116 when the plates are folded is kept as small as possible. But when it is impossible to ignore such a bulge, it is desirable to smoothen the bulge in the finishing process.

An aluminum brazing sheet is also used here to manufacture the partition 107 so that the opposite surfaces of the partition plates 112 and 113 are previously coated with a brazing agent layer.

To assemble the abovedescribed components to form a heat exchanger shown in FIG. 8, the tubes 101 are arranged at first in parallel with each other at predetermined intervals. Their ends are then inserted into the tube insertion holes 109 so that the headers 103 and 104 are connected to the tubes. Subsequently, the corrugated fin members are inserted and arranged between the tubes 101, following which the side plates 108, inlet pipe 105 and outlet pipe 106, et., are attached. Further, the partition 107 is inserted through the slit shaped aperture 110 into the header 103, and thus as shown in FIGS. 10 and 11, the partitioning parts 112*a* and 113*a* are arranged inside the header. As a result, the protruding ends 112*b* and 113*b* fit in the slit shaped aperture 110, and the ribs 112*c* and 113*c* contact the edges around the entrance of said aperture 110.

It is noted that when inserting the partition 107 into the header 103 as shown in FIG. 10 the partition is bent at the joint 115 which functions as a fulcrum, but with the unconnected sides kept slightly open. Due to this, the elasticity of the material of the partition causes the protruding ends 112*b* and 113*b* of the partition plates 112 and 113 to come into close contact with the edge of the aperture 110, whereby the partition 107 is correctly positioned in the header. If the friction between the protruding ends 112*b* and 113*b* and the edges of apertuer 110 is sufficiently strong, then the abovementioned elastic contact will not be necessary to correctly position the partition.

Because the small protrusions 114 engage with the inner edge of the slit shaped aperture 110, the partition 107 is prevented from being displaced or slipping out. Further, because the protrusions 114 are formed to slant up towards the unconnected ends of the partition, it can be inserted smoothly into the header 103.

The thus assembled heat exchanger parts are then placed in a brazing or soldering furnace, and these parts, including the abutting ends of the header pipe 103*a*, are joined to each other by the brazing process carried out in one-shot operation, thereby integrating the heat exchanger. The partition is kept at its correct position during the brazing process, and consequently is brazed firmly to the header 103 so that a heat exchanger with a highly reliable partition structure is provided.

Since the partition 107 is made of the aluminum brazing sheet affording the brazing agent layers to the facing surfaces of the partition plates 112 and 113, the gap between them is well clogged with the brazing agent during the brazing process which is carried out in one-shot operation. It is a matter of course that excellent sealing may also be obtained even if the "pre-placed solder" method or the like is employed.

Finally, due to the use of a pair of partition plates 112 and 113 that are superimposed over each other as a duplex partition 107, when compared with the prior art type that is composed of a single plate formed with a rib, the ribs 112*c* and 113*c* of the partition plates can be made thinner, and consequently they will jut out less from the outside surface of the header 103 making it possible to manufacture a heat exchanger of high merchandising value.

Third Embodiment

Figure 14:
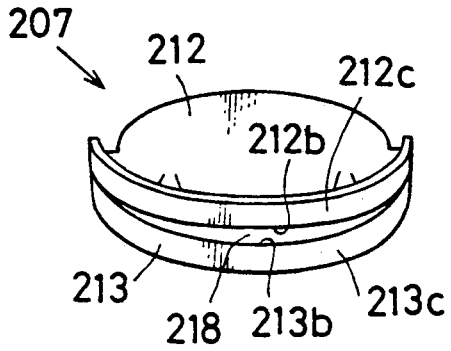
FIG. 14 is a perspective view showing a partition of a heat exchanger in a third embodiment.
Figure 15:
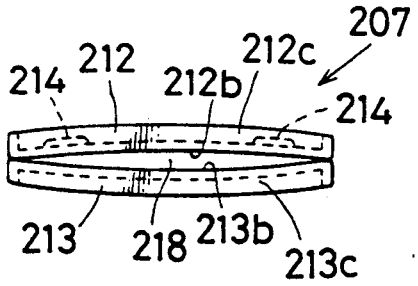
FIG. 15 is a side elevation of the partition shown in FIG. 14 and seen from its ribs' side.

FIGS. 14 and 15 show an example of a variation of the partition. A gap 218 between protruding ends 212*b* and 213*b* of such partition plates 212 and 213 that give elasticity to the structure, is drawn with a somewhat curved line to indicate that, due to a bowing process, the opposing surfaces of the plates 212 and 213 appear concave when viewed from the side. Since every thing else is the same as that in the foregoing embodiments, explanations of the symbols corresponding to those elements is not repeated here. With this embodiment, the elasticity gap 218 provides a powerful spring-like force which brings both protruding ends 212*b* and 213*b* of the partition plates 212 and 213 into contact with the edges around the slit shaped aperture 110 of the header 103, thus achieving an even more secure positioning of the partition 207.

Fourth Embodiment

Figure 16:
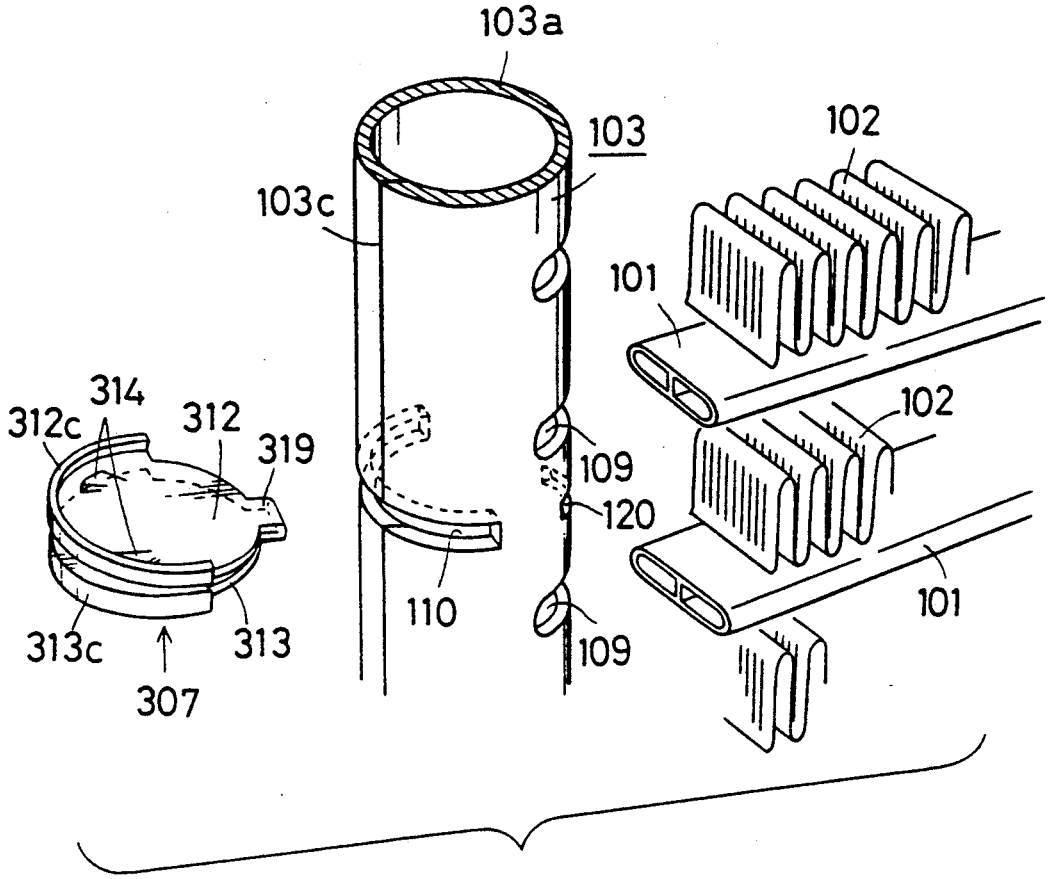
FIG. 16 is a perspective view showing in a disassembled state a header, tubes, fins and partition plates of a heat exchanger provided in a fourth embodiment of the invention.
Figure 17:
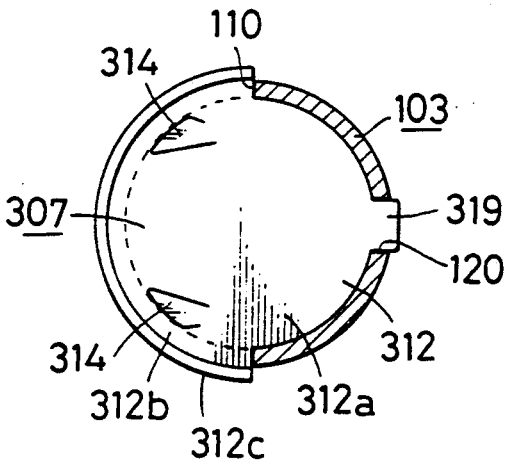
FIG. 17 is a horizontal cross section of the header with the partition fitted in position.

The embodiment shown in FIG. 16 and 17 uses a partition 307 having a small lug 319. When this partition 307 is inserted through the slit shaped aperture 110 and arranged in the header 103, the small lug 319 slips into a compatibly sized small hole 120 that has been formed on the header's wall opposite to the aperture 110. The small lug 319 can be formed by pressing an aluminum sheet to produce a preformed article which comprises partition plates 312 and 313 having their ends integrally connected by a joint, wherein the joint is of substantially the same thickness as the header wall and twice as long as it is thick. Then in the same manner as described hereinbefore, the plates are bent lengthwise at the midpoint of the joint and folded in a superimposed position over each other. Excellent positioning of the partition 307 is provided by this structure as the engagement of the small lug 319 with the small hole 120 locks the plates into position. Moreover, the bending strength is increased and there is little danger of the partition plates 312 and 313 breaking or cracking. Since every thing else is the same as that in the embodiments previously discussed, explanations of the symbols that correspond to those elements are omitted.

Fifth Embodiment

Figure 18:
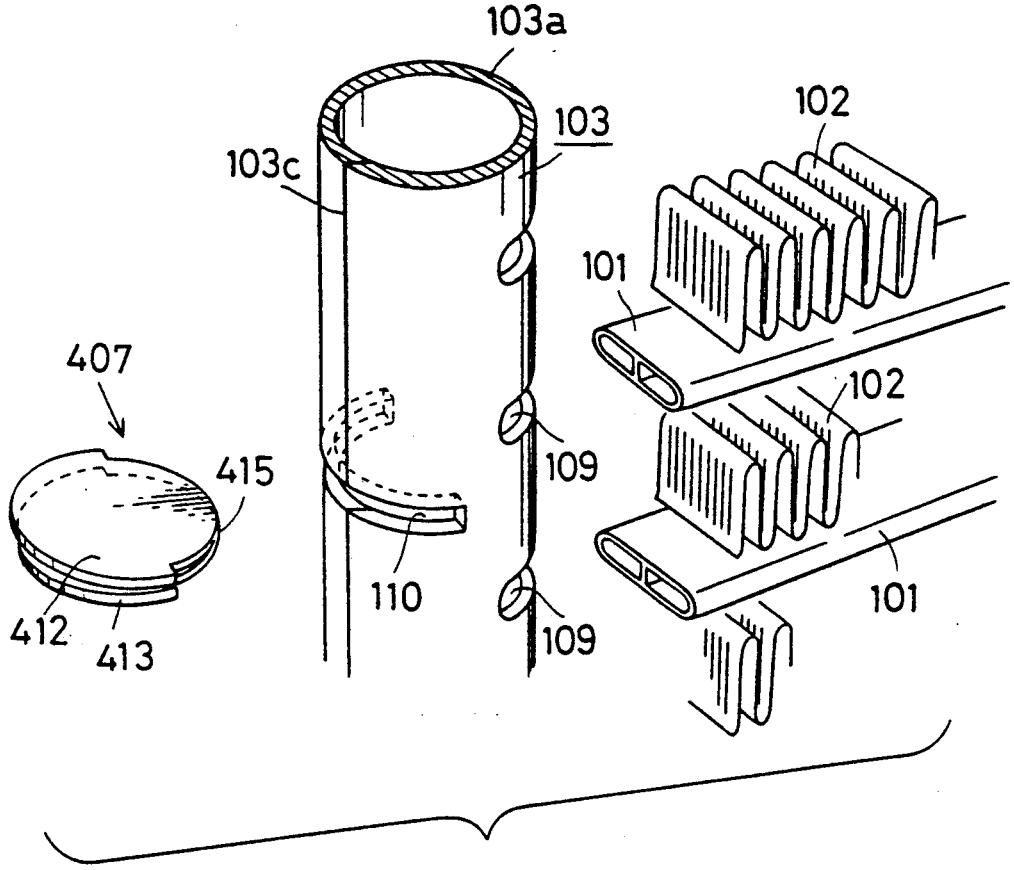
FIG. 18 is a perspective view showing in a disassembled state a header, tubes, fins and partition plates of a heat exchanger provided in a fifth embodiment of the invention.
Figure 19:
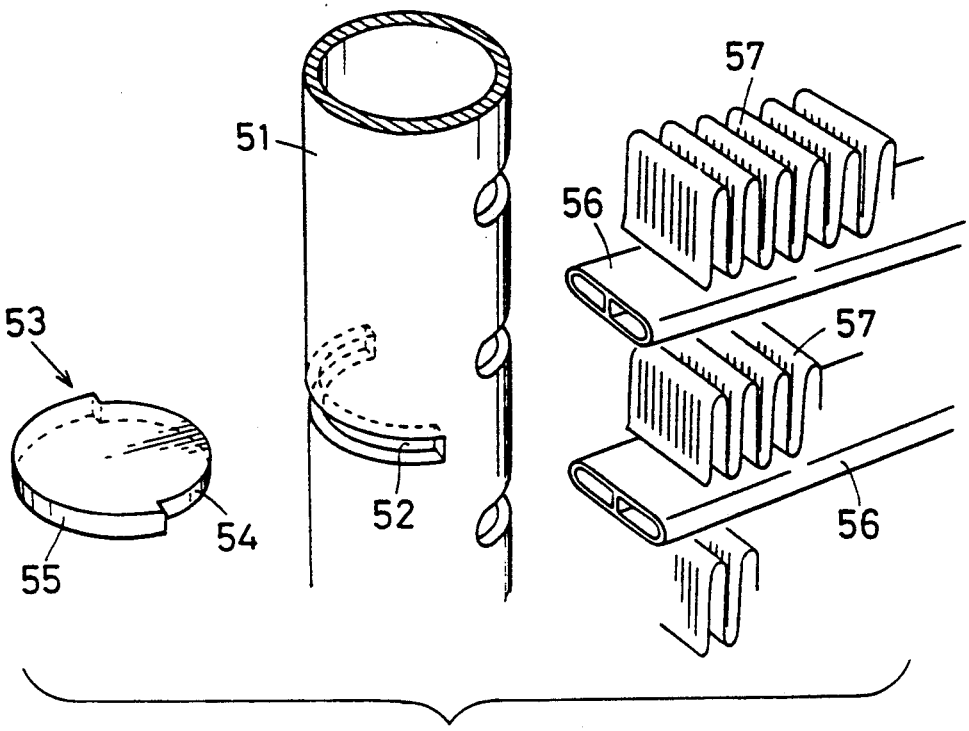
FIG. 19 (PRIOR ART)
FIG. 19 is a perspective view showing in a disassembled state a prior art heat exchanger.
Figure 20A:
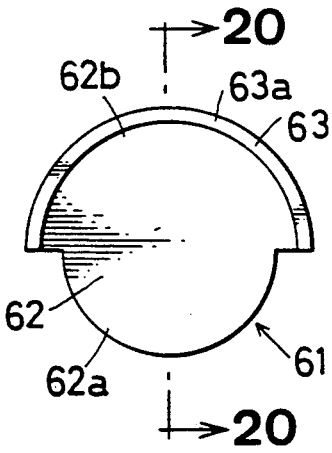
FIG. 20A (PRIOR ART)
FIG. 20A is plan view of a partition in another prior art heat exchanger.
Figure 20B:
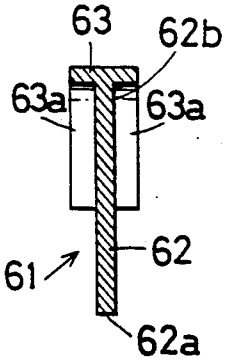
FIG. 20B (PRIOR ART)
FIG. 20B is a cross section taken along the line 20—20 in FIG. 20A.
Figure 21:
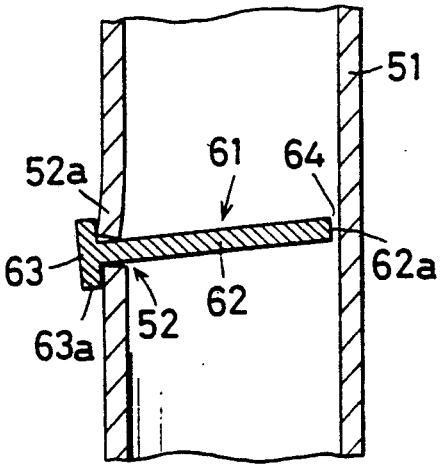
FIG. 21 (PRIOR ART)
FIG. 21 is a vertical cross section of a header with the prior art partition fitted in position.

The embodiment shown in FIG. 18 applies to a partition 407 which is formed without ribs, small protrusion or small lug. Since every thing else is the same as that in the foregoing embodiments, explanations of the symbols corresponding to those elements is not repeated here.

The heat exchanger provided in any of the second to fifth embodiments comprises a pair of partition plates superimposed on each other and mutually connected at one end. When positioned inside the slit shaped aperture the unconnected ends of both partition plates contact with the edges of said aperture and are brazed to the header in that position to integrate the heat exchanger. Therefore, they are able to prevent the partition from slipping out of position or falling out of the header after they have been inserted and before they are brazed into position. Thus, the partition can always be brazed to the header in the correct position which makes it possible to provide a heat exchanger that is highly reliable.

Further, the heat exchangers of this invention are of course suitable for use as the multi-flow types of heat echangers such as those for room air conditioners, oil coolers or the like.

What is claimed is:

1. A heat exchanger comprising:

a plurality of tubes;

hollow headers to which both ends of each tube are connected so that the tubes are in fluid connection with the hollow headers;

partitions inserted and arranged through slit shaped apertures which are formed in the headers in the direction of their circumference; and each partition being composed of two separate partition plates which are passed together through the slit shaped aperture in a superimposed position, fitted into the headers, and brazed to become integral therewith.

2. A heat exchanger as defined in claim 1, wherein each partition is substantially circular, and each partition plate thereof is composed of an inner and smaller diameter semicircular part and an outer and larger diameter semicircular part, with the inner semicircular part conforming to the shape of the interior of the header and integral with the outer semicircular part which conforms to the shape of the exterior of the header, and wherein the partition plates respectively comprise arc-shaped upright ribs which are integral with and extend along the perimeter of the external sides of partition plates, with the ribs rising up in opposite directions so as to conform to the external surface of the header.

3. A heat exchanger as defined in claim 1, wherein the two partition plates of each partition are integrated with each other through a layer of brazing agent formed to cover the opposing surfaces of the partition plates.

4. A heat exchanger as defined in claim 1, wherein each partition plate is made of an aluminum brazing sheet.

5. A heat exchanger comprising:

a plurality of tubes;

hollow headers to which both ends of each tube are connected so that the tubes are in fluid connection with the hollow headers;

partitions inserted and arranged through slit shaped apertures which are formed in the headers in the direction of their circumference; and each partition being a pair of two partition plates which are joined to each other at their ends and are positioned inside the slit shaped aperture in a superimposed position, with unconnected ends of both partition plates in contact with the inside edge of said aperture, and are brazed in that position to the header to become integral therewith 6. A heat exchanger as defined in claim 5, wherein a distance between the partition plates of each partition slightly and gradually becomes greater from their connected ends towards their unconnected ends so that the partition appears V-shaped when viewed from the side, and with the unconnected ends being in a pressed contact with the edge along the slit shaped aperture.

7. A heat exchanger as defined in claim 5, wherein each of the partition plates is substantially circular and comprises a circular part conforming to the interior surface of the header, and a protruding end integral with the circular part and jutting out radially therefrom, with the protruding ends having at their edges such upright ribs as extending therefrom in opposite directions to conform to the external surface of the header.

8. A heat exchanger as defined in claim 5, wherein the pair of the partition plates are joined together at their ends by brazing.

9. A heat exchanger as defined in claim 5, wherein the pair of the partition plates are connected through a narrow bending portion at their ends.

10. A heat exchanger as defined in claim 5, wherein small protrusions are formed on at least one of the partition plates, with the protrusions being slanted in a tapered shape extending from a position within the circular part to a border between it and the protruding end so as to stop the partition from slipping out.

11. A heat exchanger as defined in claim 5, wherein the partition plates are made of an aluminum brazing sheet.

12. A heat exchanger as defined in claim 5, wherein the partition plates are of such a concave shape as to form a gap therebetween for enhancing the elasticity of the partition.

13. A heat exchanger as defined in claim 5, wherein each partition has at its end a small lug which is inserted into a small hole of compatible size formed in the side of the header opposite the slit shaped aperture.

* * * * *